US008657190B2

(12) United States Patent
Lais et al.

(10) Patent No.: US 8,657,190 B2
(45) Date of Patent: Feb. 25, 2014

(54) APPARATUS FOR A CHECKPOINT

(75) Inventors: Lothar Lais, Schopfheim (DE); Norbert Wendt, Essen (DE); Martin Werner, Hemer (DE); Dirk Homberg, Bochum (DE); Michael Brauckmann, Witten (DE)

(73) Assignees: Magnetic Autocontrol GmbH, Schopfheim (DE); L-1 Identity Solutions AG, Bochum (DE)

( * ) Notice: Subject to any disclaimer, the term of this patent is extended or adjusted under 35 U.S.C. 154(b) by 102 days.

(21) Appl. No.: 13/138,111

(22) PCT Filed: Jan. 7, 2009

(86) PCT No.: PCT/DE2009/000014

§ 371 (c)(1), (2), (4) Date: Jul. 7, 2011

(87) PCT Pub. No.: WO2010/078856

PCT Pub. Date: Jul. 15, 2010

(65) Prior Publication Data

US 2011/0277518 A1 Nov. 17, 2011

(51) Int. Cl.
*G07B 15/02* (2011.01)

(52) U.S. Cl.
USPC ..... 235/384; 235/380

(58) Field of Classification Search
USPC ..... 235/384, 380, 492
See application file for complete search history.

(56) References Cited

U.S. PATENT DOCUMENTS

| | | | | |
|---|---|---|---|---|
| 5,291,560 | A * | 3/1994 | Daugman | 382/117 |
| 7,802,724 | B1 * | 9/2010 | Nohr | 235/384 |
| 7,905,415 | B2 * | 3/2011 | Basson et al. | 235/487 |

* cited by examiner

*Primary Examiner* — Daniel St Cyr
(74) *Attorney, Agent, or Firm* — Horst M. Kasper

(57) ABSTRACT

The invention relates to an apparatus for a checkpoint, comprising a controlled access passage, the exit of which is closed by an exit door (gate). Said exit door (5) opens in response to a signal of a least one biometric unit (8) which is arranged in the controlled access space (3) and by which the biometric features of a person desiring passage can be detected, and said biometric unit (8) is arranged frontally opposite of the entrance to the controlled access space (3) and preferably integrated in the exit door (5) of the controlled access space (3). A person entering the controlled access space (3) is therefore immediately located quasi automatically in the correct position for detection by the biometric unit (8), which is to say, frontally opposite of the biometric unit.

19 Claims, 3 Drawing Sheets

APPARATUS FOR A CHECKPOINT

The invention relates to an apparatus for a checkpoint having a passage lock whose exit is closed by an exit door (gate) which opens in response to a signal from at least one biometric unit which is arranged in the lock area and is intended to detect biometric features of a person desiring passage.

Checkpoints, as are used for security reasons in a wide variety of installations, for example when accessing particular buildings, when crossing borders, at airports and other public and private or commercial and industrial facilities, are intended to help to avoid unauthorized persons gaining access to the relevant premises or building. In the simplest case, said checkpoints consist of a gate which only opens and enables passage after a person has introduced an authorization, for example his ticket, to a control machine or could be identified at a reader by means of his ID card or passport.

Authorizations, ID cards or passports and the like may be forged or passed on in an unauthorized manner. Apparatuses in which the person does not only have an ID card or passport read but must also leave a fingerprint which then allows comparison and thus more reliable identification so that passage can or cannot be enabled are supposed to ensure better security. The practice of taking fingerprints, in particular from a multiplicity of persons in succession at the same location, encounters reservations for hygienic reasons. In addition, it had to be recognized that the fingerprint of not every person is sufficiently reliable for reliable identification throughout the world.

Apparatuses were therefore proposed in which, after an ID card or passport has been read, access through a first gate into a lock is first of all enabled for a person, in which lock the person is identified with the aid of (a) biometric unit(s), for example by means of face recognition or other biometric recognition features, after which departure from the lock or further access through a second gate is or is not enabled.

In the case of known pedestrian barriers with face recognition, the biometric units, for example (a) camera(s), are arranged in the side walls of the lock and the person who has entered the lock must be given instructions to assume a particular position and stance so that recognition can be reliably carried out. These instructions must first of all be understood and then correctly followed, with the result that there are delays with passage control again and again, which has a disadvantageous effect, in particular in the case of passageways which have a high footfall and through which persons often also pass who are not familiar with such a system. Persons may also be erroneously rejected in this case, for instance if the person has not exactly assumed the correct position or has assumed the correct position for an excessively short time.

Particular dimensions are predefined for apparatuses for a checkpoint, for example at airports; the length of the apparatuses also referred to as passage barriers is thus restricted to 2.5 meters, for example, and the width is also predefined. For this reason inter alia, it was not possible to use a so-called corner solution in which the lock passageway is intended to be angled by approximately 45° at a particular distance from the entrance gate and the camera, for example for face recognition, is intended to be installed on that angled wall of the lock passageway which is first of all approached by the person. If a plurality of passage control locks are intended to be arranged beside one another, they must be offset by a particular amount in the longitudinal direction in the case of this corner solution, as a result of which the space requirement increases and necessarily predefined dimensions cannot be complied with.

The object of the invention is to provide an apparatus for a checkpoint having biometric recognition, for example face recognition, which apparatus complies with the predefined dimensions and in which recognition can be reliably carried out without delays and in a short time, that is to say the error rate, for instance erroneous rejection of a person, must be kept as low as possible and is at best completely avoided.

This is achieved, according to the invention, with an apparatus as claimed in claim 1.

By virtue of the fact that the biometric unit is arranged frontally opposite the entrance to the lock area, a person is inevitably in the correct position frontally opposite the biometric unit upon entering the lock area without relevant instructions having to be given to the person and followed by the latter. This arrangement of the biometric unit frontally opposite the entrance to the lock area also makes it possible to arrange a plurality of passage locks beside and parallel to one another without increasing the space requirement in the longitudinal directional of the locks; the length of the locks remains the same throughout the arrangement of even a plurality of locks, with the result that the above-mentioned predefined dimensions can be reliably complied with.

The exit door of the lock area preferably consists of at least one pivoting wing which is known per se, and the biometric unit is integrated in this at least one pivoting wing. In this case too, the person is virtually inevitably in the correct position and stance with respect to the biometric unit after entering the lock area. When the pivoting wing is pivoted into the position which enables passage, the optical unit is concomitantly pivoted out of the pathway and field of view of the person and the person can quickly leave the lock area; the person is also not tempted to continue to still look at the biometric unit in the process. Unnecessary delays are avoided.

The biometric unit preferably consists of a recording apparatus, for example a camera, for detecting and recognizing biometric features, for example the face and/or the iris, of a person desiring passage, and a display for the image recorded by the recording apparatus is provided; in this case, the recording apparatus and the display are integrated in the pivoting wing of the exit door of the lock area; the recording apparatus may form a unit with the display. The person can observe and follow the recognition process on the display and, by involuntarily doing so, inevitably maintains the correct position and stance with respect to the recording apparatus (camera). After the exit door has been pivoted open, the recording apparatus and the display are outside the person's field of view and the person is not tempted to continue to look at the display but rather will quickly leave the lock area without any unnecessary delay.

Lighting means for lighting the face of the relevant person in a uniform manner with little glare, little shadow and little reflection are advantageously arranged in the lock area; reflections on glasses can thus be minimized.

The lighting means may be advantageously likewise integrated in the pivoting wing of the exit door above and/or below and/or beside the recording apparatus (camera). However, they may also be arranged laterally in the lock area.

If necessary, the lighting means can be adjustable and/or controllable.

In order to direct the attention of the person in the lock area in the correct direction, a sound generation device, for example a loudspeaker, for generating short broadband noises, such as crackling or clicking, may also be arranged in the spatial vicinity of the biometric unit. This also makes it possible for the person to assume the required position.

According to one preferred embodiment of the invention, access to the lock area is blocked by an entrance door which opens in response to a signal from a control unit for the access authorization of a person, which control unit is arranged in the entrance region. This control unit may be a device for detecting the alleged identity, in particular from authorizations or ID cards or passports, or may be a device for detecting a PIN. Pre-checking can thus already be carried out before a person enters the lock area, and this can be compared with the subsequent biometric recognition. The reliability of the check is thus increased overall.

A display unit, for example a monitor, on which the reading process can be followed can also be assigned to the device for detecting the identity in the entrance region.

A simple biometric system, for example a fingerprint scanner, can also be installed in front of or on the entrance door in order to verify access to the lock.

It is particularly advantageous if the biometric unit for detecting biometric features, in particular biometric features of the face and/or of the iris, of a person desiring passage can be vertically displaced in order to be exactly positioned with respect to the relevant person. For this purpose, an apparatus for detecting the height of the person may be arranged at the entrance to the lock area and has an electronic unit for generating a control signal for the vertical positioning unit of the biometric unit arranged downstream of it, which control signal is dependent on the height determined. The biometric unit, preferably a camera with or without a display, can thus already be changed into the correct position, namely at the person's eye level, when the person enters the lock area. Recognition can thus be carried out with the same accuracy and with the same quality in the case of persons of different heights, erroneous rejections of persons are avoided and the entire process is expedited.

The positioning unit for vertically displacing the biometric unit advantageously consists of a linear drive.

The apparatus for detecting the height of a person desiring passage may consist of a light curtain which has an electronic unit for generating a control signal for the vertical positioning unit, for example a linear drive, of the biometric unit arranged downstream of it, which control signal is dependent on said height.

The light curtain may consist of a number of light barriers arranged above one another and transversely with respect to the direction of access. The highest light barrier which is interrupted when the person enters can be used to determine the height of the latter.

The distance between the individual light barriers may be 2.5 cm. This is considered to be sufficient to determine a person's height with the required accuracy.

According to an expedient development of the invention, a plurality of light barriers are integrated in the base of the apparatus at a short distance from the floor of the lock area over the length of the latter. The position of a person in the lock area can thus be reliably determined and it is possible to detect whether any objects, for example suspicious items of luggage, have perhaps been left behind in the lock area after leaving the lock area. Imposed security requirements can therefore be met.

A plurality of light barriers may be integrated in the side walls approximately halfway up the lock area over the length of the latter. It is thus possible to detect whether a plurality of persons are in the lock area at the same time, for example, and it is possible to avoid so-called tail-gating, that is to say the attempt to concomitantly pass through a further person, perhaps without detection. The position of a person can therefore be detected in an even more reliable manner and a signal to correct the position in a corresponding manner can be generated, for example when a person comes too close to the camera.

In order to increase security further, recording apparatuses for monitoring purposes may be installed on the frame and/or on the pillars of the lock area.

The invention is described in more detail below using the attached drawings, in which.

Figure 1:
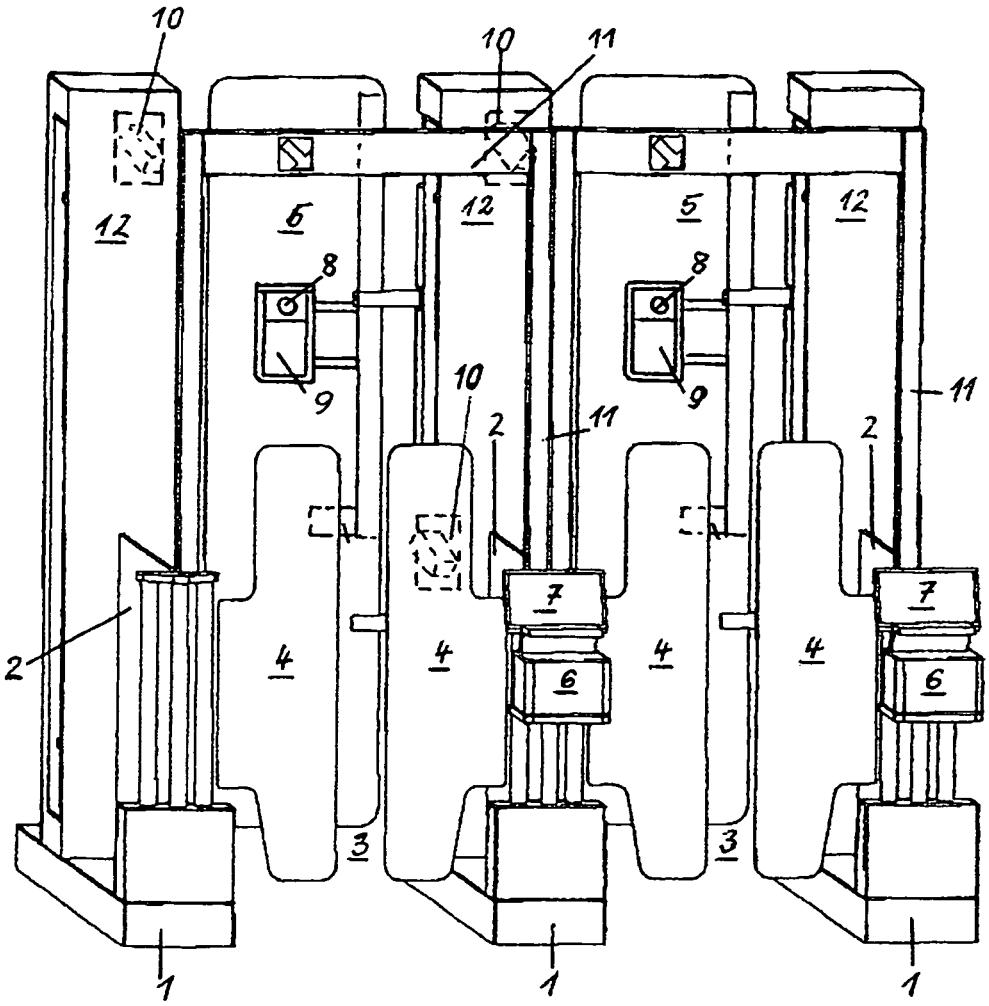
FIG. 1 shows a view of a two-line apparatus according to the invention for a checkpoint with a viewing direction of the front, closed entrance doors of the lock areas and its closed exit door located behind the entrance doors at a distance from the latter.
Figure 2:
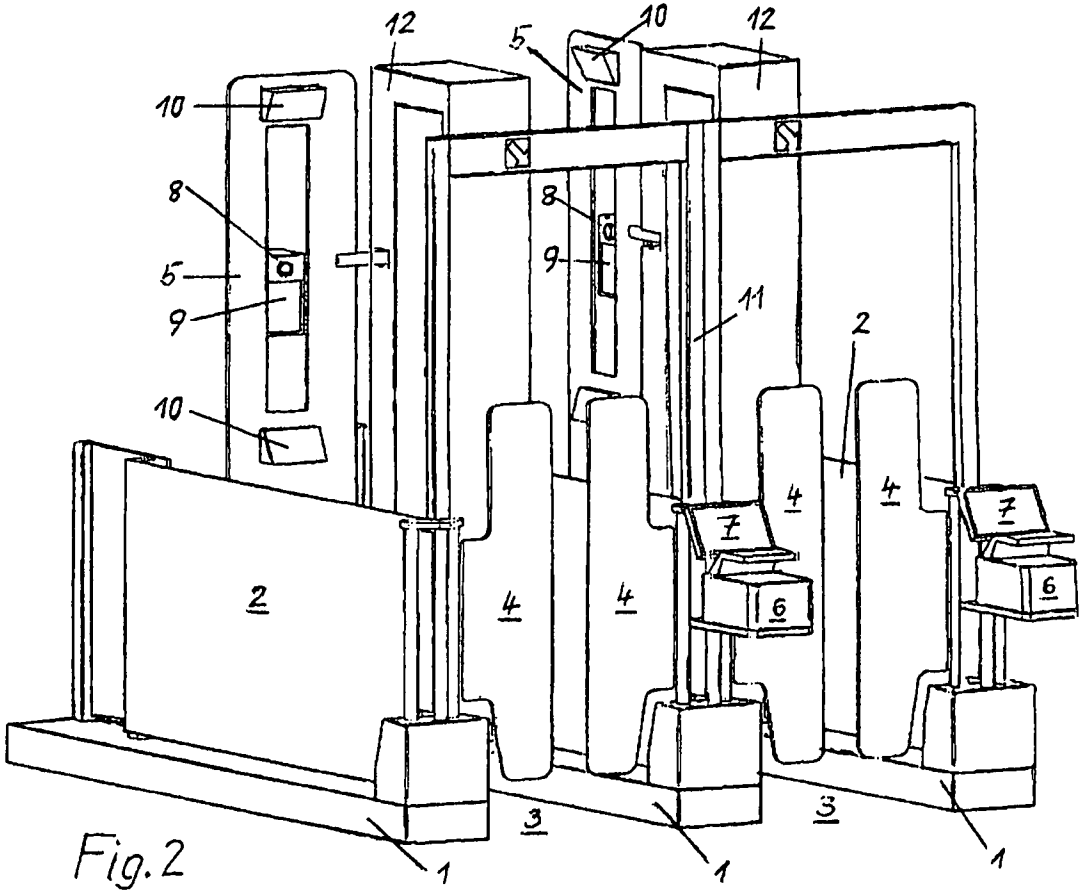
FIG. 2 shows a perspective illustration of the apparatus according to FIG. 1 with a viewing direction of the front, closed entrance doors of the lock areas and the exit doors located behind said entrance doors, one of which exit doors is closed and one of which is open.
Figure 3:
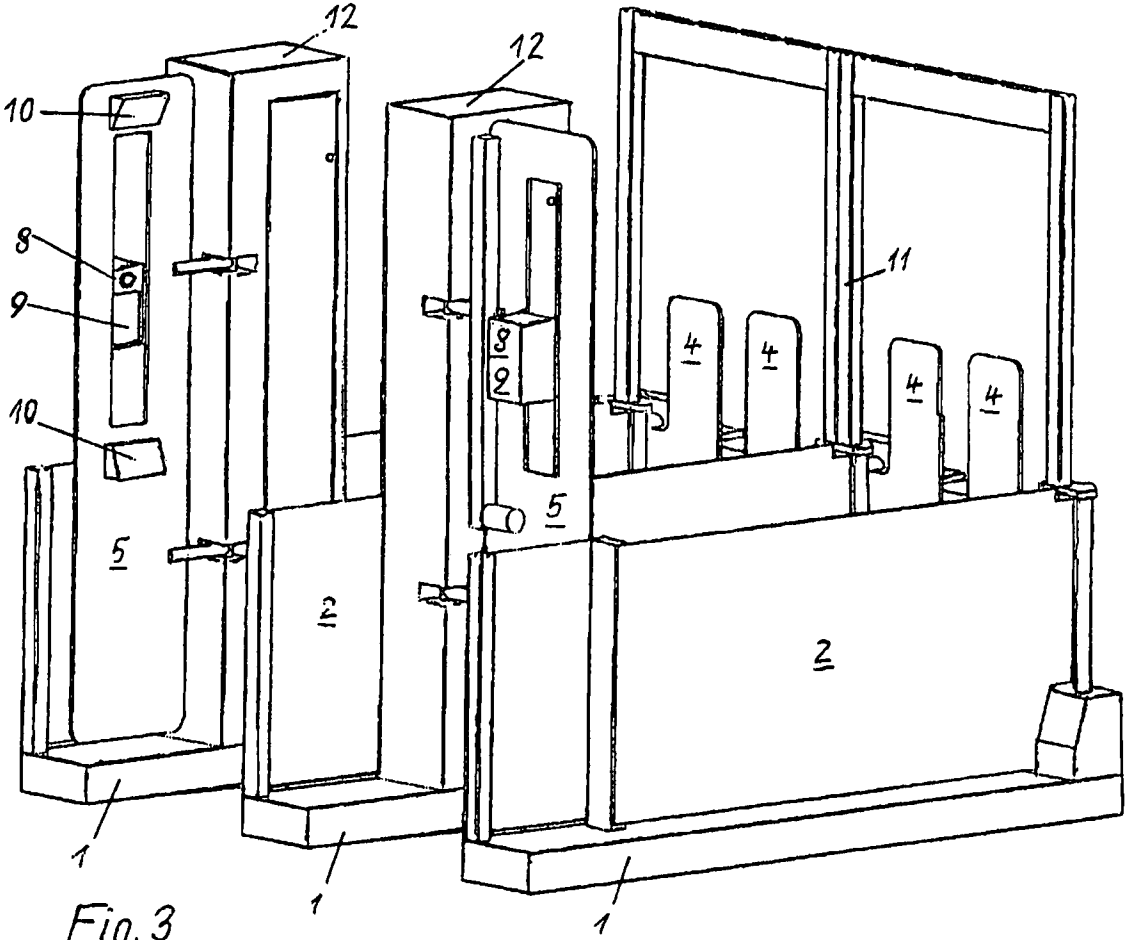
FIG. 3 shows a perspective illustration of the apparatus according to FIGS. 1 and 2 with a viewing direction of the rear exit doors of the lock areas, one of which exit doors is closed and one of which is open.

FIG. 1 shows a two-line apparatus for a checkpoint, in which case "two-line" is used to mean that two identical passage locks are arranged beside and parallel to one another. Expansion to form a three-line or four-line apparatus, for example, is likewise conceivable if necessary, as is the erection of a one-line apparatus. The side walls 2 of the lock areas 3 are permanently mounted on bases 1. A person gains access to a lock area 3 through an entrance door 4 which, in the embodiment illustrated, consists of a two-winged front swing door 4 and opens only in response to a signal from an electronic unit. The person can leave the lock area 3 through an exit door 5, a one-wing swing door 5 in the embodiment illustrated, which opens in response to a signal from a further electronic unit. A device 6 for detecting the alleged identity, for example a reader 6, is fitted in front of the one side wall 2 and to a gate frame 11 of each passage lock above the base 1 and permanently connected to the latter, into which device a person has to feed an authorization, an ID card or a passport and which is used to generate a signal in an electronic unit, a computer, in response to which signal the entrance door 4 opens. A monitor 7 on which the reading process in the reader 6 can be observed and followed and which can also be used to instruct and assist a person with operation can preferably be fitted above the reader 6. A simple first biometric system, for example a fingerprint scanner, can also be installed in front of or on the entrance door 4 in order to verify access to the lock area 3 as reliably as possible. Integrated in the pivoting wing 5 of the exit door 5 as a biometric unit is a camera 8, preferably with a display 9, for the biometric recognition, for example face recognition, the recognition of the face as a whole and/or the iris, of a person who has entered the lock area 3. The camera 8 and display 9 are thus arranged frontally opposite the entrance of the lock area 3, with the result that a person who enters inevitably assumes the required and correct, namely frontal, position with respect to the camera 8 without any special instructions. The display 9 will cause the relevant person to follow the process of image acquisition for biometric recognition on the display 9, that is to say will cause the person to remain in the required position and not to be distracted, for example turning his head in the process, which would have to result in the process being interrupted. In order to attract the person's attention and thus to achieve the frontal orientation with respect to the camera 8, a sound generation device, for example a loudspeaker which generates short broadband noises (for example crackling, clicking) which can be located by the person and thus steer a person's attention in the desired correct direction, may be arranged in the spatial vicinity of the camera 8. The display 9 displays the reflected image of the person in the spatial vicinity of the camera 8, with the result that the person receives information relating to his positioning and can intuitively correct any possible incorrect positions. Lighting means 10 are preferably likewise integrated in the pivoting wing 5 of the exit door 5 and are arranged above and below the camera 8 and the display 9 in such a manner that the face of a person is lit in a uniform manner with little glare, little shadow and little reflection in order to thus be able to obtain photographs which conform to the imposed requirements. However, it is also possible to laterally arrange the lighting means if necessary. The lighting means 10 may be adjustable.

An image which is recorded with the camera 8 or another suitable recording apparatus and is possibly selected to be the best from a plurality of images and is visible on the display 9 is evaluated in an electronic unit, such as a programmable computer, and is used to generate a signal which is forwarded to a control unit via which the pivoting wing 5 of the exit door 5 is opened or, if the worst comes to the worst, is also held in the closed position if a particular person is not intended to pass through. When the pivoting wing 5 is pivoted open, the camera 8 and the display 9 are also pivoted out of the person's field of view, with the result that the person is not tempted to continue to look at the display 9 but rather will quickly leave the lock area 3. The arrangement of the camera 8 with display 9 in the pivoting wing 5 of the exit door 5 thus also avoids unnecessary delays at the checkpoint and expedites the process, which is particularly advantageous with passage locks having a high footfall, for example at airports.

The pivoting wing 5 of the exit door 5 is between pillars 12 and is pivotably mounted on one of the pillars 12. The necessary electronic units, computers and control units can be advantageously accommodated in the pillars 12 in a space-saving manner with all accessories.

In order to obtain images which are suitable for biometric face recognition, the recording apparatus or camera 8 should, as far as possible, be at the eye level of the person to be recorded, which naturally depends on the height of a person and varies greatly from person to person. In order to respectively change the camera 8 to eye level, it can be vertically adjusted, together with the display 9, with the aid of a fast linear drive. For this purpose, the linear drive receives its command from an optical sensor which determines the height of a person upon entering the lock area 3. For this purpose, a light curtain, for example, is installed at the entrance of the passage lock, which light curtain consists of a number of light barriers which are arranged above one another and transversely with respect to the direction of passage. The person's height can be determined from the highest light barrier which is interrupted when the lock area is entered. The distance between the individual light barriers can be 2.5 cm, for example. This is considered to be sufficient to be able to determine the height with the accuracy required for that purpose. The measurement signal from the light curtain is used as a controlled variable for the linear drive which moves the unit comprising the camera 8 and the display 9 into position at eye level; fine adjustment of the camera position can then also be carried out by processing the camera image. The camera 8 has thus already been positioned correctly if the person has entered the field of view of the camera. The overall sequence of the process is thus expedited again.

According to one expedient development of the invention, a plurality of light barriers may be integrated in the base 1 of the lock area 3 over the length of the latter and at a short distance from the floor. The position of a person in the lock area 3 can thus be reliably detected and it is possible to detect whether any objects, for example suspicious items of luggage, have perhaps been left behind in the lock area 3 after leaving the lock area 3; a so-called clear gate can be carried out, thus meeting imposed security requirements.

In addition, a plurality of light barriers may be integrated in the side walls 2 approximately halfway up the lock area 3 over the length of the latter, which light barriers make it possible to detect whether a plurality of persons are in the lock area 3 at the same time, for example. It is thus possible to prevent so-called tail-gating, that is to say the attempt to concomitantly pass through a further person without detection. The position of a person can thus also be detected in an even more accurate manner and a corresponding signal to correct the position can be generated, for example when a person comes too close to the camera.

In order to increase security further, monitoring cameras may be installed on the frame 11 and/or on the pillars 12 of the lock area 3.

| List of reference symbols | |
|---|---|
| 1 | Base |
| 2 | Side wall |
| 3 | Lock area |
| 4 | Entrance door, pivoting wing |
| 5 | Exit door, pivoting wing |
| 6 | Reader, control unit |
| 7 | Monitor |
| 8 | Camera, biometric unit |
| 9 | Display |
| 10 | Lighting means |
| 11 | Gate frame |
| 12 | Pillars |

The invention claimed is:

1. An apparatus for a checkpoint having a passage lock whose exit is closed by an exit door (gate) which opens in response to a signal from at least one biometric unit which is arranged in the lock area and is intended to detect biometric features of a person desiring passage, wherein the biometric unit (8) is arranged frontally opposite the entrance to the lock area (3), wherein the exit door (5) of the lock area (3) consists of at least one pivoting wing (5) in a known manner, and wherein the biometric unit (8) is integrated in the at least one pivoting wing (5).

2. The apparatus as claimed in claim 1, wherein the biometric unit (8) is a recording apparatus (8) for detecting biometric features or the face as a whole or the iris, of a person desiring passage, wherein a display (9) for the image recorded by the recording apparatus (8) is provided, and wherein the recording apparatus (8) and the display (9) are integrated in the pivoting wing (5) of the exit door (5) of the lock area (3).

3. The apparatus as claimed in claim 2, wherein lighting means (10) for lighting the face of a person in a uniform manner with little glare, little shadow and little reflection are arranged in the lock area (3).

4. The apparatus as claimed in claim 3, wherein the lighting means (10) are integrated in the pivoting wing (5) of the exit door (5) above and/or below or beside the recording apparatus (8).

5. The apparatus as claimed in claim 3, wherein the lighting means (10) are adjustable or controllable.

6. The apparatus as claimed in claim 1, wherein a sound generation device for generating short broadband noises or crackling or clicking, is arranged in the spatial vicinity of the biometric unit (8).

7. The apparatus as claimed in claim 1, wherein access to the lock area (3) is blocked by an entrance door (4) which opens in response to a signal from a control unit (6) for the access authorization of a person, which control unit is arranged in the entrance region.

8. The apparatus as claimed in claim 7, wherein the control unit (6) is a device (6) for detecting the alleged identity from authorizations or ID cards or passports, or is a device for detecting a PIN.

9. The apparatus as claimed in claim 8, wherein a display unit (7) on which the detection process can be followed is assigned to the device (6).

10. The apparatus as claimed in claim 7, wherein a simple biometric system of a fingerprint scanner, is installed in front of or on the entrance door (4).

11. The apparatus as claimed in claim 1, wherein the biometric unit (6) for detecting biometric features of the face or of the iris, of a person desiring passage can be vertically displaced in order to be exactly positioned with respect to the person, wherein an apparatus for detecting the height of the person is arranged at the entrance to the lock area (3) or in the front region of the lock area (3), and an electronic unit for generating a control signal for the vertical positioning unit of the biometric unit (6) is arranged downstream of said apparatus for detecting the height, which control signal is dependent on said height.

12. The apparatus as claimed in claim 11, wherein the biometric unit (6) for detecting biometric features of the face or of the iris, of a person desiring passage can be vertically displaced by a linear drive.

13. The apparatus as claimed in claim 11, wherein the apparatus for detecting the height of a person desiring passage consists of a light curtain, and an electronic unit for generating a control signal for the vertical positioning unit of the biometric unit (6) is arranged downstream of said curtain, which control signal is dependent on said height.

14. The apparatus as claimed in claim 13, wherein the light curtain consists of a number of light barriers arranged above one another and transversely with respect to the direction of access.

15. The apparatus as claimed in claim 14, wherein the distance between the individual light barriers is 2.5 cm.

16. The apparatus as claimed in claim 1, wherein a plurality of light barriers are integrated in the base (1) of the apparatus at a short distance from the floor of the lock area (3) over the length of the latter.

17. The apparatus as claimed in claim 1, wherein a plurality of light barriers are integrated in the side walls (2) approximately halfway up the lock area (3) over the length of the latter.

18. The apparatus as claimed in claim 1, wherein recording apparatuses for monitoring purposes are installed on the frame (11) or pillars (12) of the lock area (3).

19. The apparatus as claimed in claim 1, wherein the biometric unit (8) is a recording apparatus (8) for detecting biometric features or the face as a whole and/or the iris, of a person desiring passage, wherein a display (9) for the image recorded by the recording apparatus (8) is provided, and wherein the recording apparatus (8) and the display (9) are integrated in the pivoting wing (5) of the exit door (5) of the lock area (3), and wherein the lighting means (10) are integrated in the pivoting wing (5) of the exit door (5) above and/or below or beside the recording apparatus (8).

* * * * *